US005497818A

United States Patent [19]

Marcarelli

[11] Patent Number: 5,497,818

[45] Date of Patent: Mar. 12, 1996

[54] WALLET TETHER AND WALLET

[76] Inventor: Hawk R. G. Marcarelli, 59610 Aberdeen Dr. #B, Yucca Valley, Calif. 92284

[21] Appl. No.: 375,711

[22] Filed: Jan. 20, 1995

[51] Int. Cl.[6] ..... A45C 1/06; A45C 13/20; E05B 73/00

[52] U.S. Cl. ..... 150/134; 24/3.7; 24/3.13; 24/265 AL; 24/302; 224/230; 224/253

[58] Field of Search ..... 150/101, 102, 150/132, 134; 190/101; 224/230, 240, 253; 24/3.7, 3.13, 265 AL, 302

[56] References Cited

U.S. PATENT DOCUMENTS

| | | | |
|---|---|---|---|
| 77,068 | 4/1868 | McNeill | 2/249 |
| 1,298,278 | 3/1919 | Bashinski . | |
| 1,380,778 | 6/1921 | Cucinotta | 150/134 |
| 1,513,383 | 10/1924 | Fleischer | 150/134 |
| 1,792,862 | 2/1931 | Oyler | 224/252 |
| 1,887,491 | 11/1932 | Johnson | 24/3.13 X |
| 2,522,606 | 9/1950 | Curry | 150/134 X |
| 2,783,926 | 3/1957 | Wise | 150/102 X |
| 2,796,905 | 6/1957 | Hebron | 150/133 |
| 2,908,306 | 10/1959 | Chorost | 150/134 |
| 3,286,751 | 11/1966 | Dishart | 150/134 X |
| 3,422,498 | 1/1969 | Carlson | 150/134 X |
| 3,802,011 | 4/1974 | Castagnola | 24/3.13 X |
| 3,881,534 | 5/1975 | Gist | 190/101 X |
| 4,159,792 | 7/1979 | Siegal | 24/3.13 X |
| 4,804,122 | 2/1989 | Knox | 150/134 X |
| 5,215,237 | 6/1993 | Wu | 150/132 X |

FOREIGN PATENT DOCUMENTS

| | | | |
|---|---|---|---|
| 2587180 | 3/1987 | France | 150/132 |
| 3150565 | 6/1983 | Germany | 150/134 |
| 2238826 | 6/1991 | United Kingdom | 150/134 |
| 2261813 | 6/1993 | United Kingdom | 150/102 |
| 2263135 | 7/1993 | United Kingdom | 150/102 |

*Primary Examiner*—Sue A. Weaver
*Attorney, Agent, or Firm*—Richard C. Litman

[57] ABSTRACT

A wallet tether is removable from a wallet or the like to which it is secured, to provide for use of the wallet in more formal situations where such a tether would be unsightly. The tether includes an openable loop which is securable about a belt, belt loop, or other appropriate structure of the apparel of the user, and an eyelet which is secured to the wallet by a threaded fastener which is passed through a hole in the wallet periphery. Thus, the wallet may be opened and the contents accessed without need to remove the tether from the wallet. An elongate, flexible cord extends between the apparel attachment loop and the wallet attachment eyelet. The cord may be non-metallic, in order to reduce to a minimum the amount of metal in the device to preclude requirement for removal for passage through metal detectors. Preferably, the cord ends are secured to the openable loop and to the wallet attachment eyelet with crimp connections, for strength, durability, and economy of manufacture.

14 Claims, 2 Drawing Sheets

WALLET TETHER AND WALLET

FIELD OF THE INVENTION

The present invention relates generally to retaining devices and the like, and more specifically to a tether one end of which may be removably installed on a wallet or other article normally carried on the person, with the opposite end being secured to the user's belt, belt loop or other point.

BACKGROUND OF THE INVENTION

Tethers and the like used to secure a wallet or billfold to the apparel of a person, are popular with many persons and in many environments. Such devices are permanently affixed to the wallet to provide greater security, and provide significant deterrence to pickpockets and other causes of theft and also serve to prevent inadvertent loss. With people generally engaging in various casual activities in their spare time, such a device can provide great piece of mind for a person carrying a wallet or the like while riding a bicycle, jogging, or engaging in other activities.

Accordingly, wallet tethers have become accepted articles for many persons engaged in less formal activities, but they are not generally seen in more formal settings. While women often own two or more purses or bags to suit various occasions (casual, on the job, formal evening occasions, etc.), men typically own and use a single wallet or billfold for all occasions. Thus, a man may not wish to purchase and use a wallet tether which is permanently secured to the wallet, with an obtrusive cord or tether which will be displayed at least whenever the wallet is removed from the pocket.

The alternative of tucking the cord or tether into the pocket and leaving it unattached to the garment or belt, still results in the cord or tether being displayed when the wallet is withdrawn from the pocket. Thus, many persons will choose to leave their wallet unprotected by such a device, rather than having an unsightly cord or tether dangling from the wallet during formal occasions. The lack of security for the untethered wallet can easily lead to loss or theft, as noted above.

Accordingly, the need arises for a wallet tether which is not only easily attachable to and removable from a belt, belt loop, or other portion of the apparel of the user, but which is also easily securable to and removable from the wallet itself. The tether must be of durable and sturdy construction, yet allow for removal from and attachment to the belt, clothing, and/or wallet of the user without requiring significant tools or complex operations.

DESCRIPTION OF THE PRIOR ART

U.S. Pat. No. 1,298,278 issued to Harry Bashinski on Mar. 25, 1919 discloses a Safety Attachment For Purses comprising a series of different, relatively short and rigid links between belt and wallet or purse. An openable belt loop connects to a snap link, which in turn is connected to a ring, which ring is in turn connected to an openable loop which is permanently attached to the wallet or purse. Thus, each wallet to be connected to the Bashinski linkage must have an attachment loop permanently secured thereto, unlike the present invention, which requires only a small passage through one corner or part of the wallet. Moreover, the flexible, elongate cord attachment of the present tether provides much greater flexibility and reach than the Bashinski linkage.

U.S. Pat. No. 1,380,778 issued to Frank Cucinotta on Jun. 7, 1921 discloses a Safety Attachment For Pocketbooks including a specially constructed wallet including closure flaps which are secured when the Cucinotta attachment is secured thereto. Cucinotta discloses a removable button with a relatively long shank which passes through the entire wallet, with the shank having a loop through which a chain is passed. Both ends of the chain connect to a button attachment to the wearer's apparel. Thus, a doubled chain—from the apparel attachment to the button shank, and thence from the button shank back to the apparel attachment must be used, and the detachable end of the chain removed from the attachment each time use of the wallet is desired, in order to remove the chain from the wallet closure button shank loop to allow opening of the wallet. The present invention is much less cumbersome and does not require removal for access to the wallet interior, which is generally secured within a pocket anyway.

U.S. Pat. No. 1,513,383 issued to Adolph Fleischer on Oct. 28, 1924 discloses a Theftproof Device For Pocketbooks, Wallets, And The Like comprising a strap which passes through a portion of a specially constructed wallet in order to be secured thereto. The strap is in turn connected to a tab with a chain extending therefrom, with the opposite end of the chain having a clasp thereon for securing to the apparel. As in the Cucinotta device discussed above, the Fleischer apparatus must be opened to provide access to the wallet interior, whereas the present invention provides for retention of the entire wallet, rather than limiting access to the interior. The Fleischer clasp does not provide positive security, as it may easily be pulled from the apparel of the wearer, unlike the present positive loop.

U.S. Pat. No. 1,792,862 issued to James F. Oyler on Feb. 17, 1931 discloses a Pocketbook And Holder Therefor partially along the lines of the Cucinotta device discussed above, in that the entire wallet is closed by the end of a chain passing therethrough with a transverse pin through the end link of the chain. A flat, open ended clip is disclosed which is secured over the belt of the wearer. As no substantial tension would be present to hold the transverse pin tightly against the wallet when the chain is slack, it appears that the pin may drop out under such circumstances (i.e., when the wallet is stowed partially within a pocket), and thus cannot provide the positive security of the present invention. Moreover, the belt clip is not as versatile as the present attachment means, and may easily be spread slightly to facilitate unauthorized removal thereof.

U.S. Pat. No. 3,422,498 issued to Ronald G. Carlson on Jan. 21, 1969 discloses a Billfold Safety Guard using a clamp and screw on the wallet and a button and shank secured through the buttonhole of the wallet pocket. The wallet clamp and the button shank are connected by a chain. The button and shank attachment end precludes use of the standard button closure of the pocket, whereby the wallet may be easily removed therefrom. Moreover, if no button is provided, then at least a buttonhole must be specially formed at the top of the pocket to provide for attachment of the Carlson device to the user's apparel. The device is not adaptable to use with a belt or belt loop, as in the present invention, and it appears that the wallet clamp could be pulled loose relatively easily due to the screw end engaging only the relatively soft surface of the wallet.

U.S. Pat. No. 5,215,237 issued to Shih-fu Wu on Jun. 1, 1993 discloses a Multi-Function Wallet comprising a specially constructed wallet and relatively complex linkage connecting it to a belt loop or the like. The linkage includes a double length of string which connects the wallet to an intermediate link, with a double length of bead chain extending between the intermediate link and an apparel attachment clip. Both the attachment clip and the intermediate link are secured to a belt or other portion of the apparel. The string or cord is permanently installed to the specialized wallet, whereas the present invention is readily adaptable to a standard wallet with little modification thereto, and may be easily removed therefrom.

Finally, British Patent No. 2,238,826 to Henry Lewis and published on Jun. 12, 1991 discloses A Wallet And Means For Connecting The Wallet To A Person. A specially constructed wallet is provided, having a tongue which engages a hook secured to a D-ring, which is in turn secured to a belt worn by the user. Further security is provided by a chain which is secured to a zipper tab on the wallet, with the opposite chain end being secured to the belt. A lock (preferably combination type) on the wallet provides for the locking of a strap thereto, which strap extends from the wallet attachment hook. The entire arrangement is relatively complex and bulky, and the lock must be unlocked to access the contents of the special wallet or to remove the wallet from the hook and remaining belt attachment means.

None of the above noted patents, taken either singly or in combination, are seen to disclose the specific arrangement of concepts disclosed by the present invention.

SUMMARY OF THE INVENTION

By the present invention, an improved wallet tether is disclosed.

Accordingly, one of the objects of the present invention is to provide an improved wallet tether which is removably attachable to a conventional wallet or the like, with the wallet needing little modification and no additional structure permanently attached thereto.

Another of the objects of the present invention is to provide an improved wallet tether which includes a single, non-metallic elongate and flexible cord extending between a wallet attachment end and an apparel attachment end.

Still another of the objects of the present invention is to provide an improved wallet tether which apparel attachment end comprises an openable loop which is securable about a belt, belt loop extending from the apparel, or other apparel fixture.

A further object of the present invention is to provide an improved wallet tether which wallet attachment end comprises an eyelet which is removably secured to a wallet by means of a threaded fastener passing through a hole in the wallet periphery.

A final object of the present invention is to provide an improved wallet tether for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENT

Figure 1:
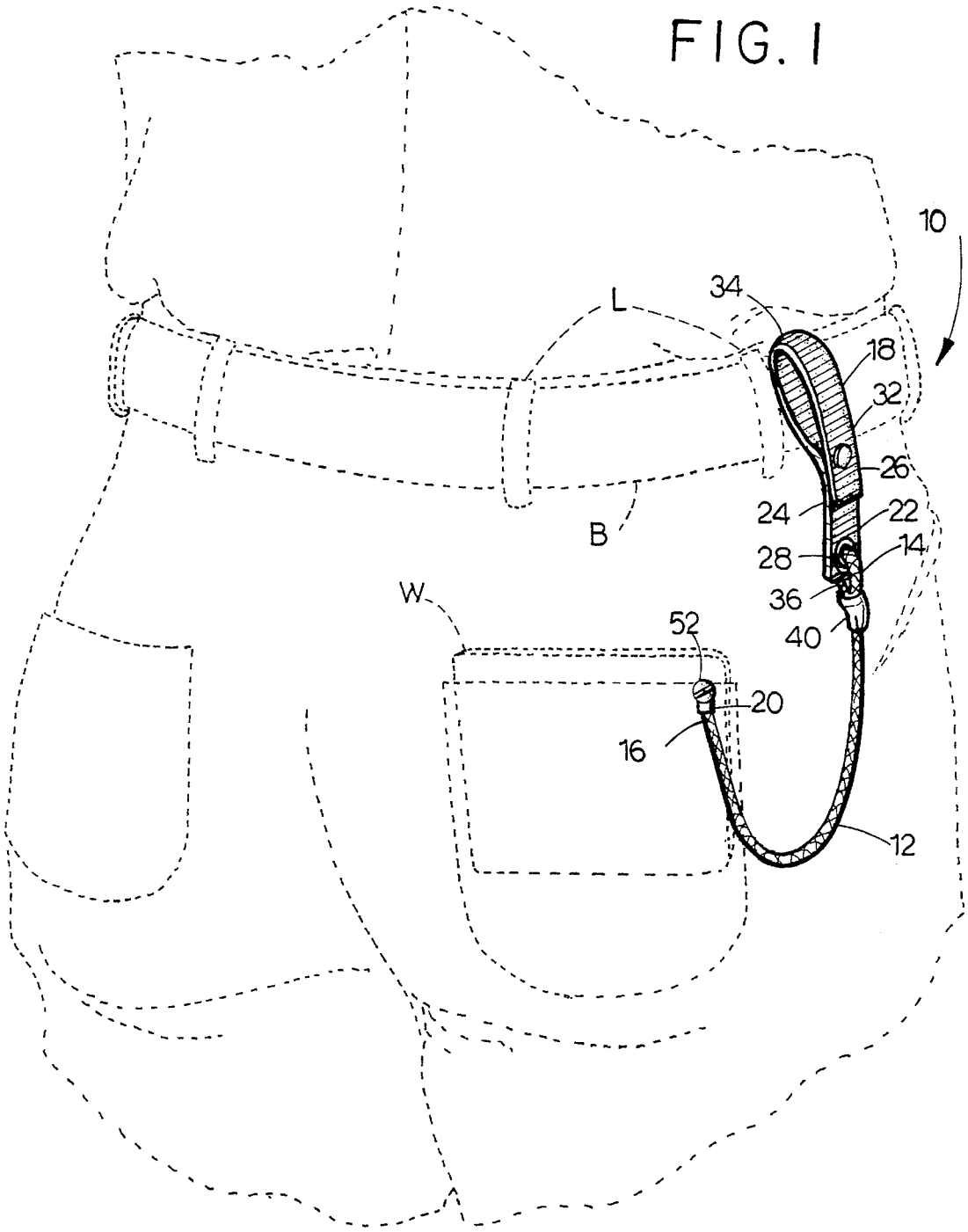
FIG. 1 is an environmental perspective view of the present wallet tether, showing its attachment to a belt and a wallet.

Referring now particularly to FIG. 1 of the drawings, the present invention will be seen to relate to a wallet tether 10, which is removably securable to both a wallet W and to some portion of the apparel (e.g., belt B or belt loop L of the user thereof. The wallet tether 10 comprises a single length of cord 12, with the cord having opposite first and second ends 14 and 16. The first end 14 is permanently secured to an apparel attachment loop 18, while the second end 16 is permanently secured to (preferably crimped within) a rigid, preferably metal, eyelet 20 (more clearly shown in FIG. 2), which eyelet 20 provides attachment means to the wallet W.

The apparel attachment loop 18 comprises a single length of material having a first end 22, an intermediate portion 24, and an opposite second end 26. The first end includes a grommet 28 installed therein, with the first end 14 of the cord 12 being permanently installed through the grommet 28, as will be explained further below.

Figure 2:
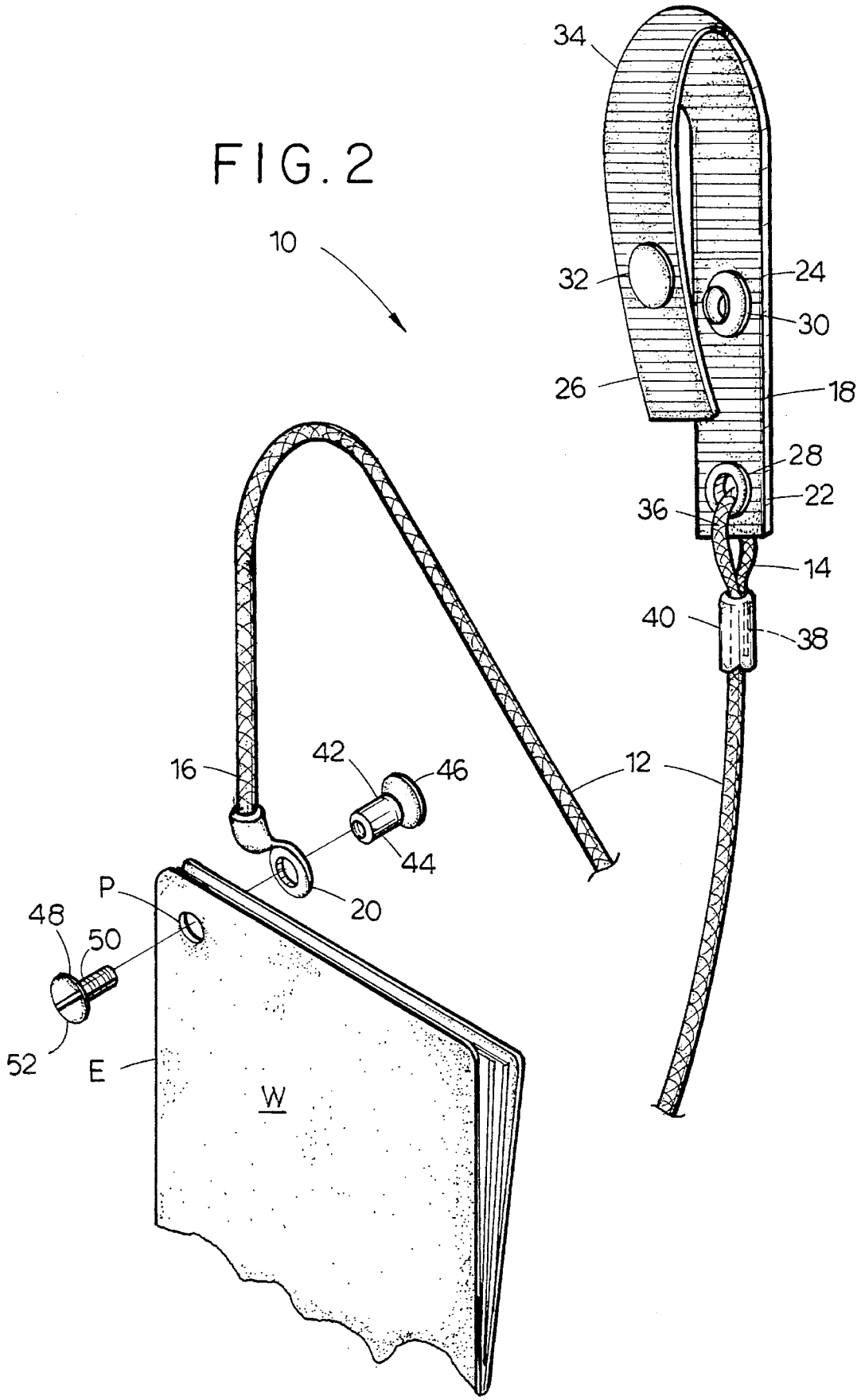
FIG. 2 is an exploded perspective view of the wallet tether, showing details of the belt or belt loop attachment means and the wallet attachment means at each end of the connecting cord.

The intermediate portion 24 of the attachment loop 18 includes a first snap fastener portion 30 installed therein, as shown in the detail of FIG. 2. The second end 26 of the attachment loop 18 includes a second snap fastener portion 32 therein, which is selectively securable to the first snap fastener portion 30 to form a positively closable loop portion 34 of the apparel attachment loop 18 when the two snap fastener portions 30 and 32 are secured together.

The first end 14 of the cord 12 is permanently secured through the attachment loop grommet 28, by means of a cord loop 36 formed in the first end 14 of the cord 12. The tip 38 (shown in broken lines) of the cord first end 14 is secured (e.g., crimped) within a sleeve 40, along with a portion of the cord 12, to define a cord loop 36 extending from the sleeve 40. This permanent cord loop 36 is formed after the tip 38 of the cord first end 14 is passed through the apparel attachment loop grommet 28, to secure the cord 12 permanently to the extended first end 22 of the apparel attachment loop 18.

As noted above, the opposite second end 16 of the cord 12 has an eyelet 20 crimped or otherwise permanently secured thereto. The eyelet 20 provides for the passage of removable wallet attachment means therethrough. The wallet attachment means may be any of a number of different types of fasteners (e.g., threaded bolt and nut, etc.), but preferably comprises a first fastener component 42 having a hollow, internally threaded shank 44 with a flange 46 extending from one end thereof, and a second fastener component 48 having a male threaded shaft 50 which mates with the hollow, internally threaded shank 44 of the first fastener component. The second fastener component includes a head 52 extending therefrom.

The eyelet 20 may thus be removably secured to a wallet W, by providing a tether attachment passage P through the border or periphery E thereof. (It will be noted that the attachment passage P need only be provided through a single ply of the wallet W, so that the wallet W is not held shut by the fastener components 42 and 48 when they are secured through the wallet passage P.) The internally threaded shaft 44 of the first fastener component 42 is passed through the wallet passage P and thence through the eyelet 20, whereupon the second fastener component 48 is threaded into the first fastener component 42 to secure the wallet W to the eyelet 20. The apparel attachment loop 18 is then snapped in place around the belt B, belt loop L, or other suitable attachment point of the user of the present tether 10, with the snap fastener components 30 and 32 being snapped together to form a positively closed loop 34 about some portion of the apparel of the user. Thus, a wallet W is removably, but positively, secured to the apparel of a user of the present tether, without reliance upon frictional attachment means which may slip or otherwise become disconnected.

When the user of the present tether 10 wishes to use his wallet W without the tether 10, i.e., in a more formal setting where such a tether 10 would be considered unattractive, he need only unsnap the two snap fastener components 30 and 32 to open the loop portion 34 of the apparel attachment loop 18, and remove it from his apparel (belt, belt loop, etc.). The wallet W may be easily detached, by unscrewing the second fastener component 48 from the first component 42, and withdrawing the first component 42 from the wallet W. Thus, an essentially conventional wallet W may be used with the present invention, with the exception of a single, unobtrusive tether attachment passage P through the periphery E.

While certain of the components of the present wallet tether 10 are preferably formed of metal for strength and durability, it will be seen that the cord 12 and the apparel attachment loop 18 may be formed of non-metallic materials, if desired. Thus, the only metal components are the mating snap fasteners 30 and 32 and the grommet 28 of the apparel attachment loop 18, the sleeve 40 and eyelet 20 crimped to the cord 12, and the first and second wallet attachment components 42 and 48, which components are relatively small. Such a wallet tether 10 will be seen to be quite convenient to persons who have occasion to pass through metal detectors from time to time (e.g., airline travelers, court officials, etc.), by greatly reducing the amount of metal in the wallet tether 10. Any one of a number of non-metallic materials (e.g., leather, woven or braided fabric cord and/or strapping, etc.) may be used to form cord 12 or attachment loop 18, as desired.

In summary, the present wallet tether 10 will be seen to be extremely valuable to persons having a single wallet W and who require positive security for that wallet W carried on their person, and yet do not wish to carry such a tether device in certain perhaps more formal environments. The present wallet tether 10 is quickly and easily secured to both a wallet W having a single, small and unobtrusive passage P therethrough, and to an existing belt B, belt loop L, or other attachment point on the apparel of the user, to positively secure a wallet W to the apparel of the user. When it is not desired to carry the tether 10, it may be just as easily removed by simply disconnecting the apparel attachment loop 18 from the apparel and the wallet attachment components 42 and 48 from the wallet W, with the wallet W remaining essentially conventional with only a small and unobtrusive tether attachment passage P through the border or periphery E thereof.

It is to be understood that the present invention is not limited to the sole embodiment described above, but encompasses any and all embodiments within the scope of the following claims.

I claim:

1. A wallet in combination with a wallet tether, the combination comprising:

a wallet including a periphery through which passes a tether attachment passage;

a single length of flexible cord having a first end and an opposite second end;

a sleeve capturing said first end of said cord and an adjacent portion of said cord to define a cord loop extending from said sleeve;

a single length of material having, a first end including a grommet installed therein, said cord loop permanently secured through said grommet, an intermediate portion having a first connector portion installed therein, and an opposite second end having a second connector portion installed therein, said second connector portion selectively connectable to said first connector portion to form an apparel attachment loop between said second end and said intermediate portion with said first end extending therefrom; and wallet attachment means securing said second end of said cord to the periphery of said wallet at the tether attachment passage.

2. The wallet and wallet tether of claim 1 wherein:

said sleeve is crimped to said cord.

3. The wallet and wallet tether of claim 1 wherein:

said first and said second connector portion comprise a mating snap connector.

4. The wallet and wallet tether of claim 1 wherein:

said second end of said cord includes a rigid eyelet secured thereto, with said wallet attachment means comprising mating first and second threaded fastener components removably securable through said rigid eyelet of said second end of said cord and with said fastener components being adapted to pass through said tether attachment passage formed in said periphery of said wallet to secure said tether to said wallet.

5. The wallet and wallet tether of claim 4 wherein:

said first fastener component comprises a hollow, internally threaded shank with a flange extending from one end thereof, and said mating second fastener component comprises a male threaded portion with a head extending therefrom, whereby;

said first fastener component is passed through said rigid eyelet of said cord second end and also through said tether attachment passage in said periphery of said wallet, and said mating second fastener component is threaded into said first fastener component to positively secure said wallet to said tether.

6. The wallet and wallet tether of claim 4 wherein:

said rigid eyelet is crimped to said second end of said cord.

7. The wallet and wallet tether of claim 1 wherein:

at least said cord and said apparel attachment loop are formed of non-metallic materials.

8. A wallet tether, comprising:

a single length of flexible cord having a first end and an opposite second end;

a sleeve capturing said first end of said cord and an adjacent portion of said cord to define a cord loop extending from said sleeve;

a single length of material having, a first end including a grommet installed therein, said cord loop permanently secured through said grommet, an intermediate portion having a first connector portion installed therein, and an opposite second end having a second connector portion installed therein, said second connector portion selectively connectable to said first connector portion to form an apparel attachment loop between said second end and said intermediate portion with said first end extending therefrom; and wallet attachment means secured to said second end of said cord, with said wallet attachment means providing for the removable attachment of said wallet tether to a wallet.

9. The wallet tether of claim 8 wherein:

said sleeve is crimped to said cord.

10. The wallet tether of claim 8 wherein:

said first and said second connector portion comprise a mating snap connector.

11. The wallet tether of claim 8 wherein:

said second end of said cord includes a rigid eyelet secured thereto, with said wallet attachment means comprising mating first and second threaded fastener components removably securable through said rigid eyelet of said second end of said cord and with said fastener components being adapted to pass through a passage formed in the periphery of the wallet to secure said tether to the wallet.

12. The wallet tether of claim 11 wherein:

said first fastener component comprises a hollow, internally threaded shank with a flange extending from one end thereof, and said mating second fastener component comprises a male threaded portion with a head extending therefrom, whereby;

said first fastener component is passed through said rigid eyelet of said cord second end and also through a passage in the periphery of the wallet, and said mating second fastener component is threaded into said first fastener component to positively secure the wallet to said tether.

13. The wallet tether of claim 11 wherein:

said rigid eyelet is crimped to said second end of said cord.

14. The wallet tether of claim 8 wherein:

at least said cord and said apparel attachment loop are formed of non-metallic materials.

* * * * *